US007374171B1

(12) United States Patent
Mencarelli

(10) Patent No.: US 7,374,171 B1
(45) Date of Patent: May 20, 2008

(54) CARD-BASED BOARD GAME AND METHOD OF PLAYING THE SAME

(76) Inventor: Dea A. Mencarelli, 5700 Mencarelli Dr., La Salle, ON (CA) N9H 2M6

( * ) Notice: Subject to any disclaimer, the term of this patent is extended or adjusted under 35 U.S.C. 154(b) by 113 days.

(21) Appl. No.: 11/353,664

(22) Filed: Feb. 13, 2006

(51) Int. Cl.
*A63F 3/00* (2006.01)

(52) U.S. Cl. ..... 273/243; 273/255; 273/262

(58) Field of Classification Search ..... 273/243, 273/255, 262
See application file for complete search history.

(56) References Cited

U.S. PATENT DOCUMENTS 3,874,671 A * 4/1975 Smith ..... 273/254
4,346,897 A * 8/1982 Sisak ..... 273/271
4,930,788 A * 6/1990 Roccanova ..... 273/248
2003/0094758 A1 * 5/2003 Hardie et al. ..... 273/243

* cited by examiner

*Primary Examiner*—Vishu K. Mendiratta
(74) *Attorney, Agent, or Firm*—Steve M. Clemmons

(57) ABSTRACT

The present invention provides a board game and a method of playing a board game in which players follow a path while acquiring competition cards that are provided in certain classes and have varying game values and features. These cards are employed by players during a head-to-head competition phase in which players secretly select cards and the cumulative value of the selected cards determine which player wins a particular competition phase. The winning player may select one of the losing player's cards that were used in the competition. The game is won when a player acquires cards totaling over a certain value and that player reaches a final destination along the path.

18 Claims, 8 Drawing Sheets

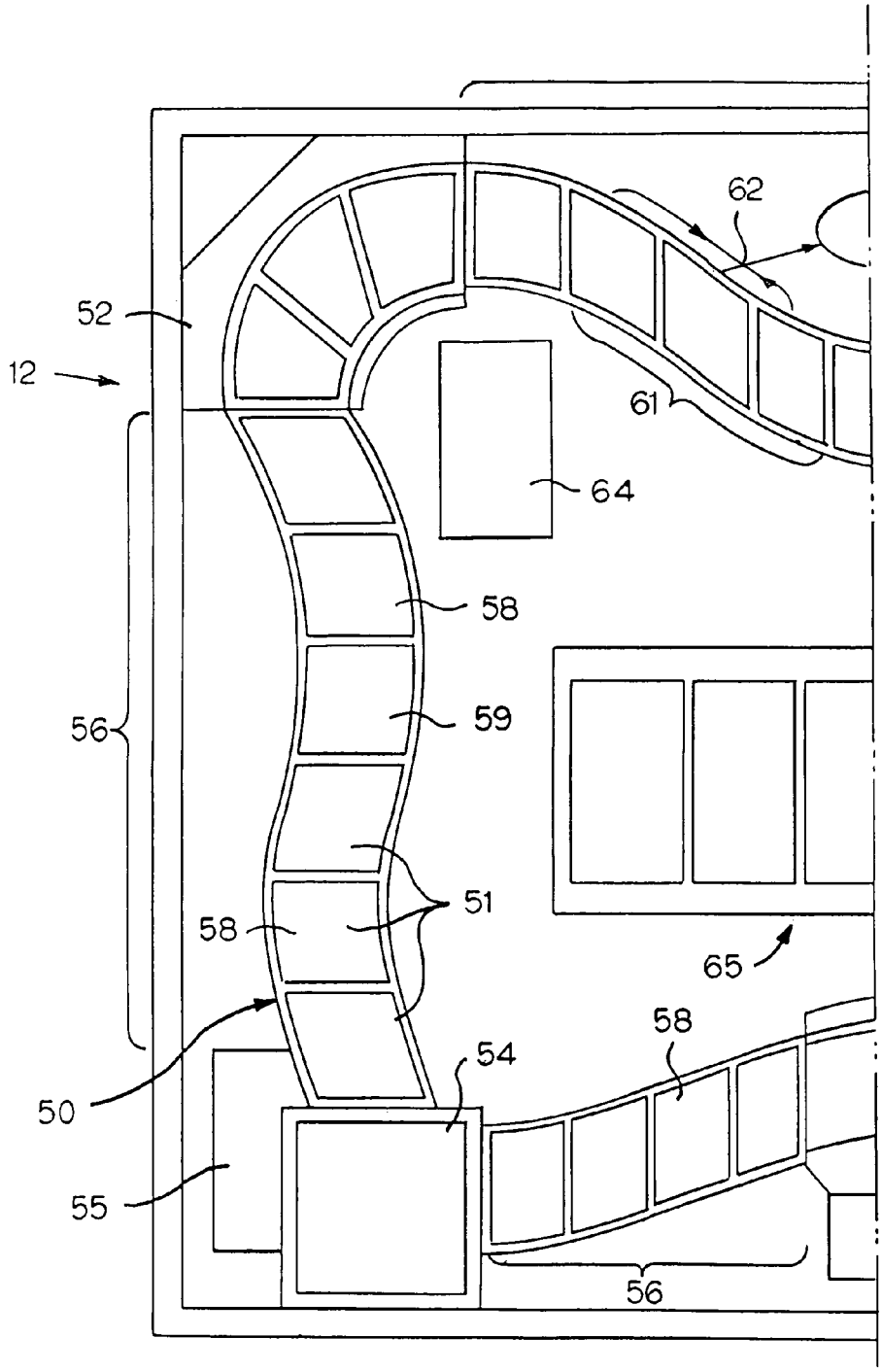
FIG. 2A
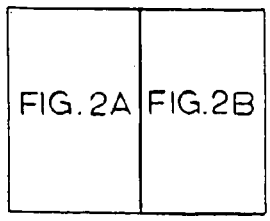

CARD-BASED BOARD GAME AND METHOD OF PLAYING THE SAME

FIELD OF THE INVENTION

The present invention relates generally to a board game and more specifically, a board game in which the players obtain cards having increasing game values. These cards are utilized during the game where the cumulative values of player selected cards determine the outcome of competition rounds between game players.

BACKGROUND OF THE INVENTION

Currently there are numerous board games available to the public in which the players use tokens or game pieces which follow a path provided on a game board. During the game, the players move along the path and follow instructions printed on the path or are given options from which to choose. These board games are typically involve the players attempting to be the first to reach or accomplish a common goal in order to win the game.

Generally, board games can be divided into three types of games: race games, acquisition games, and strategy games.

The first type of game, race games, are "races" in that the first player to reach the goal is the winner. In this type of game, the players usually do not have any direct effect on their opponent's game, thus limiting game strategy to decision which only benefit or hinder themselves (e.g., which path to follow). Some prior art games that fall into this category include Candyland® and Life®.

The second type of game, acquisition games, involve the attainment, usually through purchase with game scrip, of components or other game commodities. Typically, to win the game, the players attempt to collect the commodities the fastest. Usually, the amount of scrip and number of commodities are limited, thus some strategy is involved in determining which commodities should be purchased. These types of games, however, do not allow for direct competition between the players. The players merely take passive actions which may or may not immediately affect their opponents (e.g., charging rent to opponents to occupy a particular space). Examples of this type of game include Cooties® and Monopoly®. One drawback of these games is that once a player obtains a desirable commodity it is almost impossible to cause that player to relinquish that commodity, leaving other players less opportunity to win the game.

The third type of game, strategy games, are typically battle or combat related in which players attempt to defeat their opponents by attacking their opponent's game pieces/positions while defending their own. These games involve a great deal of strategy as each player is attempting to directly affect each of the opposing players. Examples of this type of game include chess and Risk®. These games suffer from the drawback that the players must either rely on strict predetermined rules (e.g., "attacking" player in chess always takes the "defending" piece) or must rely on chance to determine whether a move is successful (e.g., rolling dice against each other). Leaving critical portions of the game to chance, however, is often an undesirable means of determining whether your game strategy is effective.

The present invention provides for a game and a method of playing the game that overcomes all of the above stated drawbacks.

SUMMARY OF THE INVENTION

The present invention provides a game and a method for playing a game in which players traverse a game board while collecting game cards which represent a variety of game-themed upgrades or improvements that are classified in different categories. These cards are utilized or equipped by the players during head-to-head competitions where the outcome of the competition is determined by the cumulative game value afforded to each card.

The present invention includes features of all three of the above-identified prior art board games while overcoming disadvantages attributed to these games. That is, the present invention provides a board game in which the players follow a game path divided into a collection of game spaces. Some of the spaces prescribe certain actions the player must follow, while other spaces offer the player the option to act or not.

The present game also offers the player the opportunity to acquire game commodities provided as game cards. These game cards are divided into separate classes and these cards may be selectively purchased using themed game scrip (i.e., money) during the game. The cards further a player's game experience as the cards are used in a competition phase of the game in which two players compete or "battle" against one another by secretly selecting cards and comparing the game value of the cards played by the two players to determine which player wins the competition or battle.

In the preferred embodiment, the winner of a competition phase may select one of the losing opponent's game cards utilized during that competition or an amount of play money or game scrip. In this manner, desirable game cards that a player believes will benefit him in a competition may be lost to an opponent, if he loses. The winner may elect to take an amount of game scrip instead of taking a card from the loser.

One non-limiting advantage of the present invention is to provide a game system comprising a game board having a game path thereon. The game path comprising a plurality of adjacent spaces which traverse the game board around a periphery of the game board, a plurality of game pieces, a random number generator; and a plurality of cards that are classified in at least three classes, each of the cards has a certain numeric value.

It is another advantage of the present invention that it is directed to a method of playing a board game comprising the steps of: providing a plurality of cards that are classified in at least three classes, each of the cards having a numeric value; moving a game piece around a path formed from a plurality of spaces, based upon an outcome of a random number generator; collecting the cards as each game piece traverses the path; and entering a competition phase between two game players when both players occupy the same space, the competition phase comprising: selecting one card from at least one of the classes; and comparing a cumulative value of the selected cards, wherein the player with a higher cumulative value is declared the competition phase's winner.

It is a further advantage of the present invention to provide a method of playing a game in which players move around a game board collecting game cards, each of the game cards having a numerical game value. The game includes a competition phase comprising the following steps: selecting a number of game cards collected moving around the game board; revealing the selected game cards; and comparing a cumulative game value of the selected cards.

BRIEF DESCRIPTION OF THE DRAWINGS

The present invention will become more fully understood from the detailed description and the accompanying drawings, wherein:

FIGS. 2A and 2B are two halves of a top view of the game board of the game illustrated in FIG. 1;

DETAILED DESCRIPTION OF THE PREFERRED EMBODIMENTS

Figure 1:
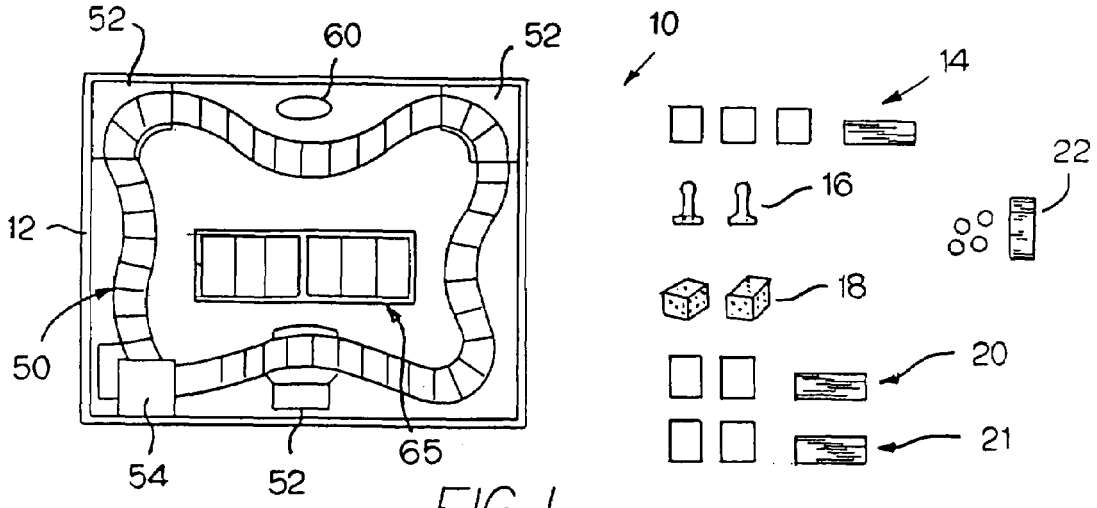
FIG. 1 is a top plan view of a board game in accordance with the preferred embodiment of the present invention.

Referring now to FIG. 1, the present invention is directed to a board game 10 including a game board or playing surface 12, game cards 14, player representative tokens or game pieces 16, random number generator 18, event cards 20, and game scrip 22. In the preferred embodiment, board game 10 is configured around a central theme wherein the board 12, cards 14, 20, tokens 16, and scrip 22 are each stylized to follow the central game theme. For example and without limitation, if the theme for game 10 were a medieval/fantasy theme, then the above listed game features 12-22 would be each stylized along the same medieval/fantasy theme and could include: knights, wizards, magic, swords, and shields as possible representative portions along this theme.

In the preferred embodiment, tokens 16 are small icons that are each shaped into a theme specific emblem that each player selects as a marker to keep the player's place on the board 12 while the game 10 is played. In other non-limiting embodiments, the tokens 16 may be of differing colors to further assist players in differentiating between the tokens 16 in play.

The random number generator 18, in the preferred embodiment, is provided as a pair of six-sided dice. In other embodiments, random number generator 18 may be a numbered spinner or an electronic device incorporating a random number generating chip or programming.

Additionally, in the preferred embodiment, game scrip 22 is a game-themed monetary system that allows the players to buy and sell game commodities and to pay for other game related costs. That is, scrip 22 is "fake money" that the players use during the course of the game to pay for various facets of the game. In the preferred embodiment, the scrip 22 is divided into differing values (e.g., $1, $5, $10, $20, $50, $100 "bills") to facilitate ease of use in the game 10. The scrip 22, in one embodiment, is a plurality of coin-sized cardboard pieces that are colored and stylized to represent the scrip's worth in the game (e.g., one cardboard coin 22 may be silver in color and have the numeral 100 printed on its face).

Figure 3:
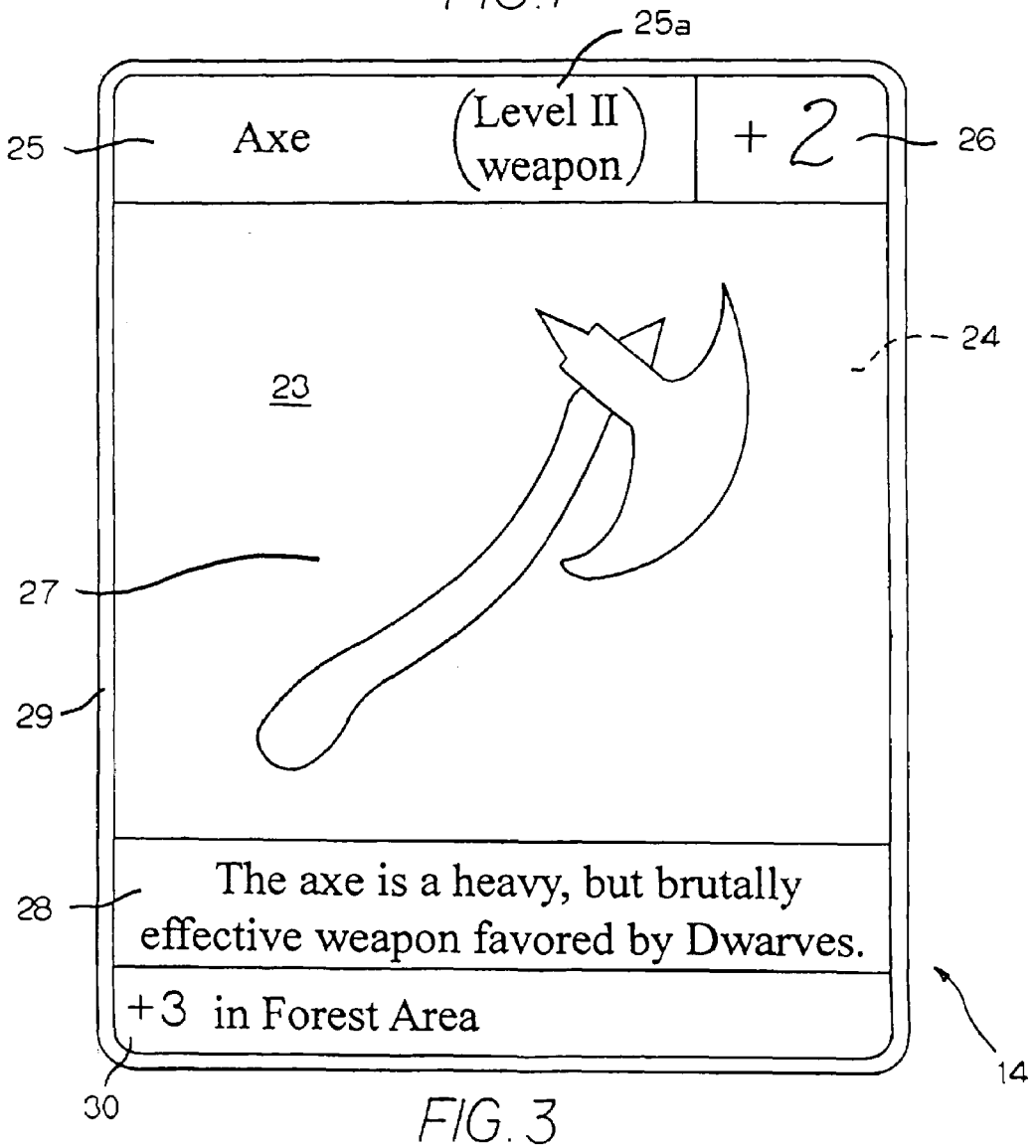
FIG. 3 is a front view of an exemplary game card of the game illustrated in FIG. 1.
Figure 4:
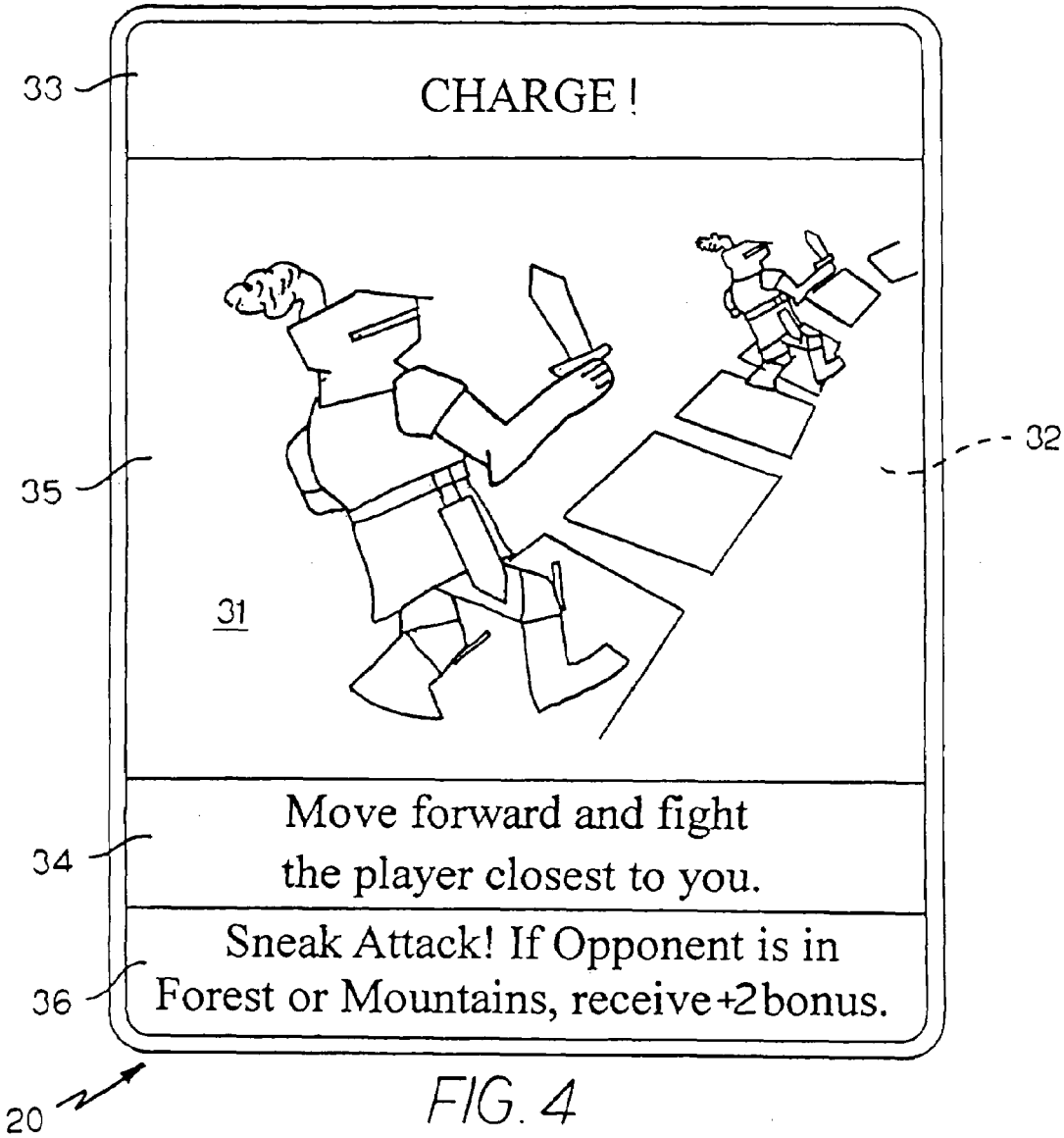
FIG. 4 is a front view of an exemplary event card of the game illustrated in FIG. 1.
Figure 5:
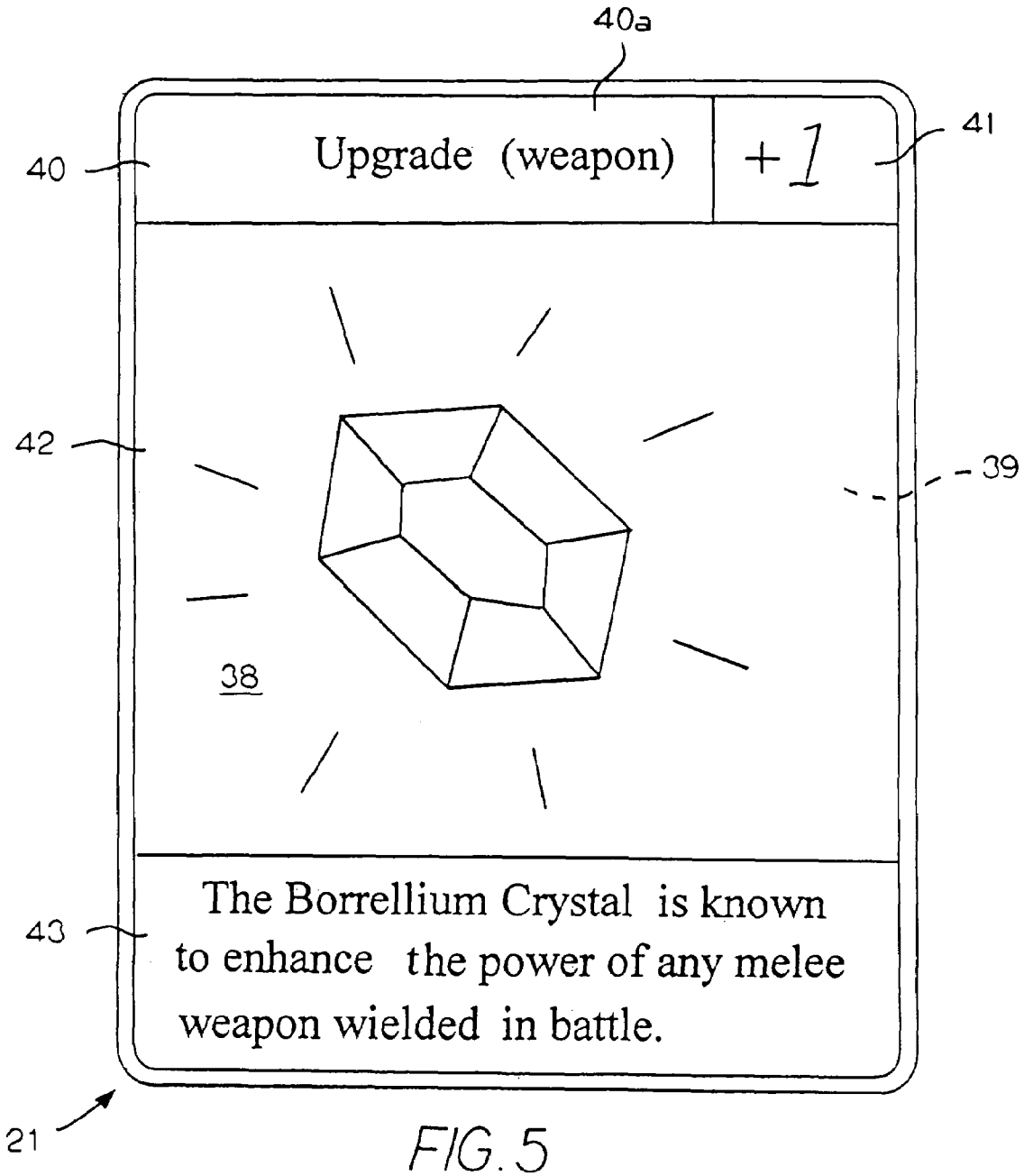
FIG. 5 is a front view of an exemplary supplemental card of the game illustrated in FIG. 1.

As shown best in FIGS. 3-5, the remaining components of game 10 are a collection or stack of game cards 14, event cards 20, and power-up or supplemental cards 21. Each card 14, 20, 21 is a piece of resilient paper material, such as card stock, that is approximately the size of a standard playing card.

As shown in FIG. 3, each game card 14 has a front surface 23 and a rear surface 24. The rear surface 24 of each of the game cards 14 is identical to each other and may be stylized in a game-themed pattern or configuration. The front surface 23 of each game card 14 includes a plurality of information boxes. Information boxes 25, 26 are disposed along the top edge of the card 14 and include a card title and level box 25 and a game value box 26.

As will be described in greater detail below, a plurality of game cards 14 are included in game 10 and each of these cards is categorized into one of a plurality of classes. The game cards 14 are categorized into at least two game classes. In the preferred embodiment, the game cards 14 are categorized into three game classes. The three classes can be generally described as primary cards, secondary cards, and tertiary cards. In one preferred embodiment, the primary cards are primary attack cards, the secondary cards are secondary attack cards, and the tertiary cards are defense cards.

Each class is a distinct game-themed category or type, which is easily distinguished from each other. In a specifically themed game 10, each of these classes has a descriptive title. For example and without limitation, if the game theme is the above-mentioned medieval/fantasy theme, then the cards 14 may be divided into three easily distinguishable and distinct classes having titles such as: weapons (primary attack card), shields (defense card), and magic cards (secondary attack card).

In other embodiments of the game 10, game cards 14 may not be categorized as attack and defense cards, but may be categorized into a number themed classes as long as those classes can be readily distinguished between each other. For example, in an automobile racing game, the cards 14 may be classified into Engine class cards, Chassis class cards, Brakes class cards, and Suspension class cards.

Within each game card class, the game cards are further divided into different levels. Box 25 provides information to the player relating to the type or class of the game card 14, the level of the card 14 within the class, and gives a descriptive title of that particular card (e.g., Axe, Weapon Class, Level II). In the preferred embodiment, the title box 25 includes indicia 25*a* indicating what class the card 14 belongs to and details the card's level within that class. The levels of different game cards 14 that are displayed in box 25 generally start at level one and increase in increments of one. Each game card has a numerical game value assigned to it (e.g., +2). This game value is printed in box 26. That is, box 26 provides a space for this numeric value to be displayed on each card 14. As a general rule, the higher the level of a game card, the higher the game value (e.g., a level 1 game card may have a game value of +1 while a level 2 game card might have a game value of +2 or +3).

Surface 23 also includes a picture portion 27, which provides an area to display a game-themed representation of the descriptive title shown in box 25. In the above example, a drawing or picture of an axe would be displayed in portion 27. In one preferred embodiment, each card 14 also includes an information box 28. In box 28, the player is provided with additional game-themed details or stories about the card 14. A colored border 29 may be provided on some of the cards 14, which may correspond to certain portions of the game board 12 described in greater detail below. Additionally, an alternative or secondary value box 30 may be provided on certain cards 14. Box 30 includes a different numeric value for the card 14 and instructions as to when in the game this numeric value is utilized instead of the value shown in box 26.

It should be appreciated that more than one of each game card 14 is included in the game 10. In the preferred embodiment, there is enough of each different game card 14 to allow each player to collect two of each card 14. That is, if the game 10 is intended for up to eight players, then there are sixteen copies of each of the game cards 14 included in the game 10.

As shown in FIG. 4, event cards 20 are similar to game cards 14 in size and shape, but have different front and rear surfaces 31, 32. Particularly, the rear surface 32 of each card 20 is identical to each other, but is different in color and/or style from cards 14. This variation in rear surfaces allows the players to readily distinguish the game cards 14 from the event cards 20.

The front surface 31 of the event cards 20 include a title box 33 which is disposed along the top edge of the card and includes a title which generally describes the card 20. A command or effect portion 34 is also provided and describes the effects of the particular event card 20 to the players. Pictorial box 35 provides a visual representation of the command or effects described in portion 34. In one embodiment, a supplemental box 36 provides additional information to the players, regarding the effects of the card 20 during certain game situations. For example and without limitation, box 36 may provide a player with a temporary increase or decrease in attack value during a competition phase (described in greater detail below).

As shown in FIG. 5, supplemental cards 21 are similar to cards 14, 20 in size and shape, but have different front and rear surfaces 38, 39. Particularly, the rear surface 39 of each card 21 is identical to each other, but is different in color and/or style from cards 14, 20. This variation in rear surfaces allows the players to readily distinguish the supplemental cards 21 from the other cards 14, 20.

The front surface 38 of the supplemental cards 21 include information boxes, areas, or portions 40, 41 disposed along the top edge of the card 21 and include a card title box 40 and a game value box 41. Box 40 provides information to the player relating to the type of game card and gives a descriptive title of that particular card (e.g., Upgrade, Weapon).

The supplemental cards 21 are divided into the same number of classes as the game cards 14 and each class of game card 14 is associated with a particular supplemental card 21.

In the preferred embodiment, the title box 40 includes indicia 40*a* indicating which class of game card 14 the supplemental card 21 affects. Box 41 provides a numeric value to each card 21 (e.g., +1). Surface 38 also includes a picture portion 42, which provides an area to display a game-themed representation of the descriptive title shown in box 40. In one preferred embodiment, each card 21 also includes an information box 43. In box 43, the player is provided with additional game-themed details or stories about the card 21.

It should be appreciated that more than one of each supplemental card 21 is included in the game. In the preferred embodiment, there is enough of each different supplemental card 21 to allow each player to collect two of each card 21. Further, the above described boxes 40, 41 describe portions of the card which provide a user game related information. These boxes may be disposed in any configuration or orientation on the card.

Figure 2B:
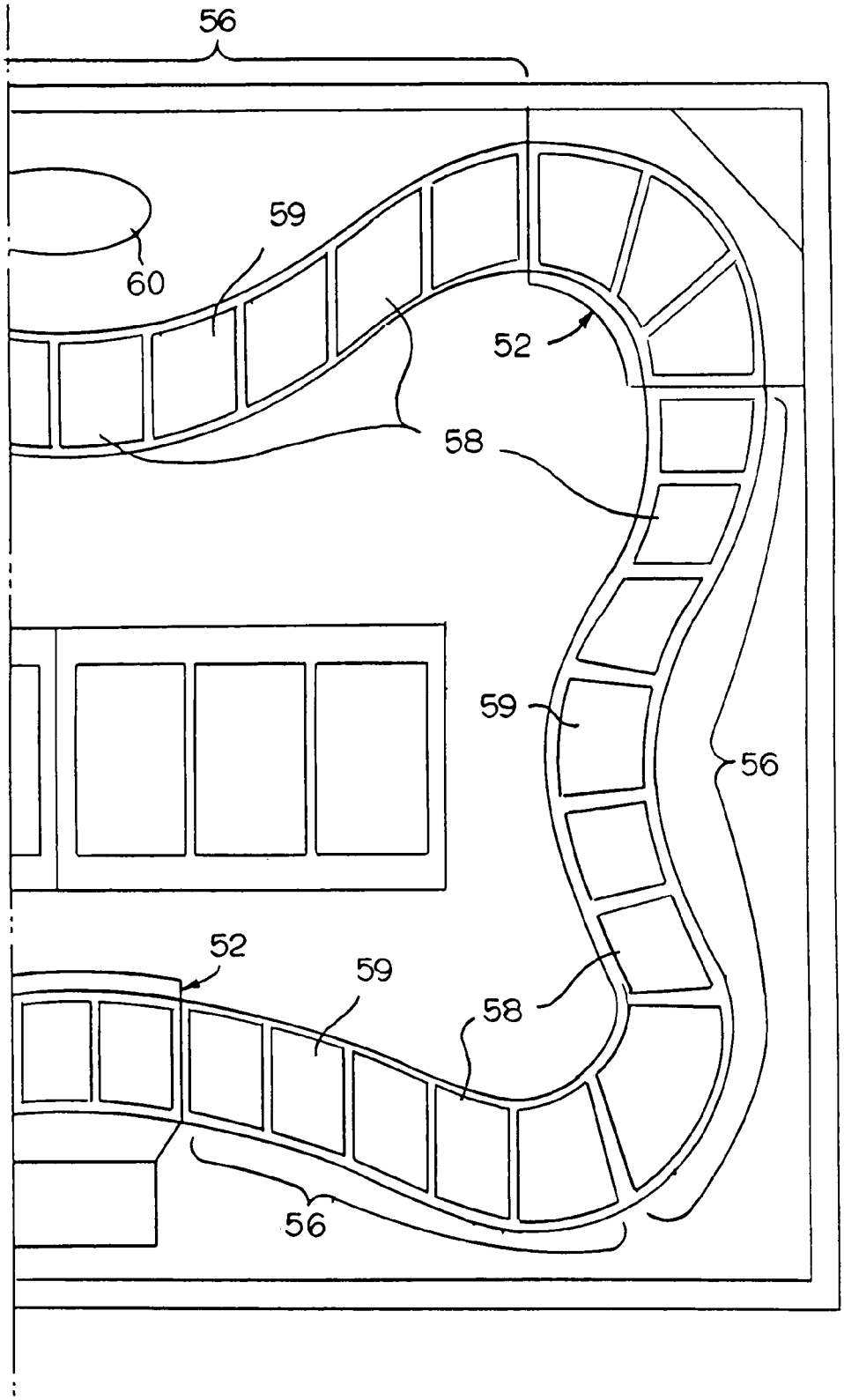

Referring now to FIG. 2, the board or playing surface 12 of the game 10 is shown. Board 12 includes a path 50. The path 50 is formed from a plurality of individual spaces 51 which are printed on board 12 adjacent to each other. That is, in a manner where each space 51 abuts two other spaces. Path 50 is formed as an enclosed loop which generally follows a circuit around the periphery of the board 12.

Additionally, board 12 includes a plurality of store spaces 52. These stores 52 are disposed along the path 50 and are represented as a region or area on board 12 which encloses or surrounds at least one space 51. In the preferred embodiment of the invention, three stores 52 are formed along the path 50 and each store 52 is occupied by three adjacent spaces 51. In one non-limiting embodiment, the three stores 52 are spaced apart along the path 50 so that the stores are approximately evenly spaced from each other.

In the preferred embodiment of the game 10, a starting point or space 54 is also disposed along the path 50. This starting point 50 includes a penalty region or space 55 that is offset or apart from the path 50.

Additionally, in the preferred embodiment, the path 50 is divided into different regions or zones 56. These zones 56 may be differentiated between each other via different colors or game-themed stylization (e.g., a street racing themed game 10 could be divided into a city zone, an expressway zone, a suburbs zone, and a off-road zone) where each zone 56 is clearly demarcated from the other zones.

Further, certain spaces along the path 50 are designated as trap or ambush spaces 58. These spaces 58 include markings or indicia which clearly show that these spaces 58 are different than the normal game spaces 51. In the preferred embodiment two ambush spaces 58 are disposed in each of the different zones 56.

Still further, another set of spaces 59 along path 50 that differ from the normal game spaces 51 are the event card spaces 59. These spaces 59 are marked or include indicia which designate these spaces as spaces which relate to the event cards 20. In the preferred embodiment, one event card space 59 is provided within each of the different zones 56.

One portion of the board 12 includes a goal or final region 60. This region 60 is printed on the board 12 apart from the path 50. In the preferred embodiment, the goal 60 is ornately stylized to clearly indicate that this portion of the game 10 represents the final or end phase of the game. Additionally, the region 60 includes indicia indicating the required game value needed to complete the game 10.

In the preferred embodiment, at least one space along the path is stylized as a threshold or portal space 61 which is in proximity to the final region 60. Indicia and markings are included which clearly show to the players that the threshold space 61 represents a separate path 62 off of path 50 which leads to the goal 60. In the preferred embodiment, three adjacent spaces are marked as threshold spaces 61 and include a fee in the applicable game scrip 22 required to follow the alternate path 62 leading to the goal 60.

A portion of the board 12 is demarcated as an event card area 64. Area 64 is a region of the board 12 that is approximately the same size and shape of the event cards 20 and allows the players to set the deck of event cards on the board 12 to allow each player access to the event cards 20.

The board 12 also includes a competition area 65. The competition area 65 is a portion of the board 12 sized and marked to provide two players of the game separate areas to place at least one game cards 14 onto the area 65 during a competition phase of the game 10. In the preferred embodiment of the invention, six areas are provided for two players (three per player) to lay three game cards 14 onto the board 12. These three areas each include indicia and markings which describe different classes of game card 14.

While the present invention is illustrated without a particular game theme, one skilled in the art will recognize that a board game 10 in accordance with the present invention could be provided with a variety of different game themes may be utilized for this game 10. The following represent only a few examples of possible game themes and include only exemplary embodiments of the game board 12, game cards 14, tokens 16, event cards 20, supplemental cards 21, and scrip 22.

In one embodiment, the game 10 has a previously mentioned medieval/fantasy theme. In this embodiment, there are three stores 52: a Blacksmith's Shop; a Magic Store; and an Armory. The start space 54 is represented as a Castle, while the penalty space 55 is represented as a Dungeon. There are four zones 56 in this embodiment and they are represented by both a title and a color. The four zones 56 are: a Woods region that has a red color designation; a Water region having a blue color designation; a Mountains region having a yellow color designation; and a Plains region having a purple color designation. Further, the portal spaces 61 are designated as a Ferry which leads to the goal 60. The goal 60 is designated and stylized as the Sorcerer's Island.

In this embodiment, the game cards 14 have three classes: Weapons, Magic, and Shields.

The Weapons class of game cards 14 has five levels: a Knife card is a level 1 card and has a game value of +1; an Axe card is a level 2 card and has a game value of +2. The Axe card includes a colored border 29 which is the same as the Woods zones 56; a Sword card is a level 3 card and has a game value of +3; an Enchanted Sword card is a level 4 card and has a game value of +4; and a Magic Staff card is a level 5 card and has a game value of +7. Additionally, a Hammer game card 14 is provided. The Hammer card has a game value of +2 and is a level 1 card. The Hammer card has a colored border 29 which is the same as the Mountains zone 56.

The Shield class of game cards 14 has four levels: a Wooden Shield card is a level 1 card and has a game value of +1; a Steel Shield card is a level 2 card and has a game value of +3; a Stone Shield card is a level 3 card and has a game value of +4; and a Magic Shield card is a level 4 card and has a game value of +6.

The Magic class of game cards 14 has five levels: a Fire Storm card is a level 1 card and has a game value of +2; a Water Storm card is a level 2 card and has a game value of +3; an Electrical Storm card is a level 3 card and has a game value of +4; a Wind Storm card is a level 4 card and has a game value of +5; and an Ultimate Storm card is a level 5 card and has a game value of +8. Additionally, each of the first four level Magic cards include a border 29 which is different in color corresponds to one of the four zones 56 along the path 50. The Fire Storm card has a red border. The Water Storm card has a blue border. The Electrical Storm card has a yellow border. The Wind Storm card has a purple border.

Additionally, in this embodiment, the supplemental cards 21 are divided into three different types of Crystals which are associated with each of the three classes: Weapons, Magic, and Shield. That is, one of the supplemental cards is associated with the Weapons class game card 14, another supplemental card is associated with the Magic class game card, and yet another supplemental card is associated with the Shield class of game card.

Further, in this embodiment, there are a plurality of event cards 20, these cards 20 include commands such as: "You have found the Hammer"; "You receive an Axe"; "Pay _____"; "You lose a _____" (game card 14); "Go to the Dungeon"; "Go to the _____" (one of the stores 52 or to a portal space 61); "Move forward and fight the player closest to you"; and "Fight an opponent of your choice". In this embodiment, some of the above listed event cards 20 are included in the game 10 as multiples (i.e., more than one of the same event card 20 is included in the stack of cards 20).

Figure 6A:
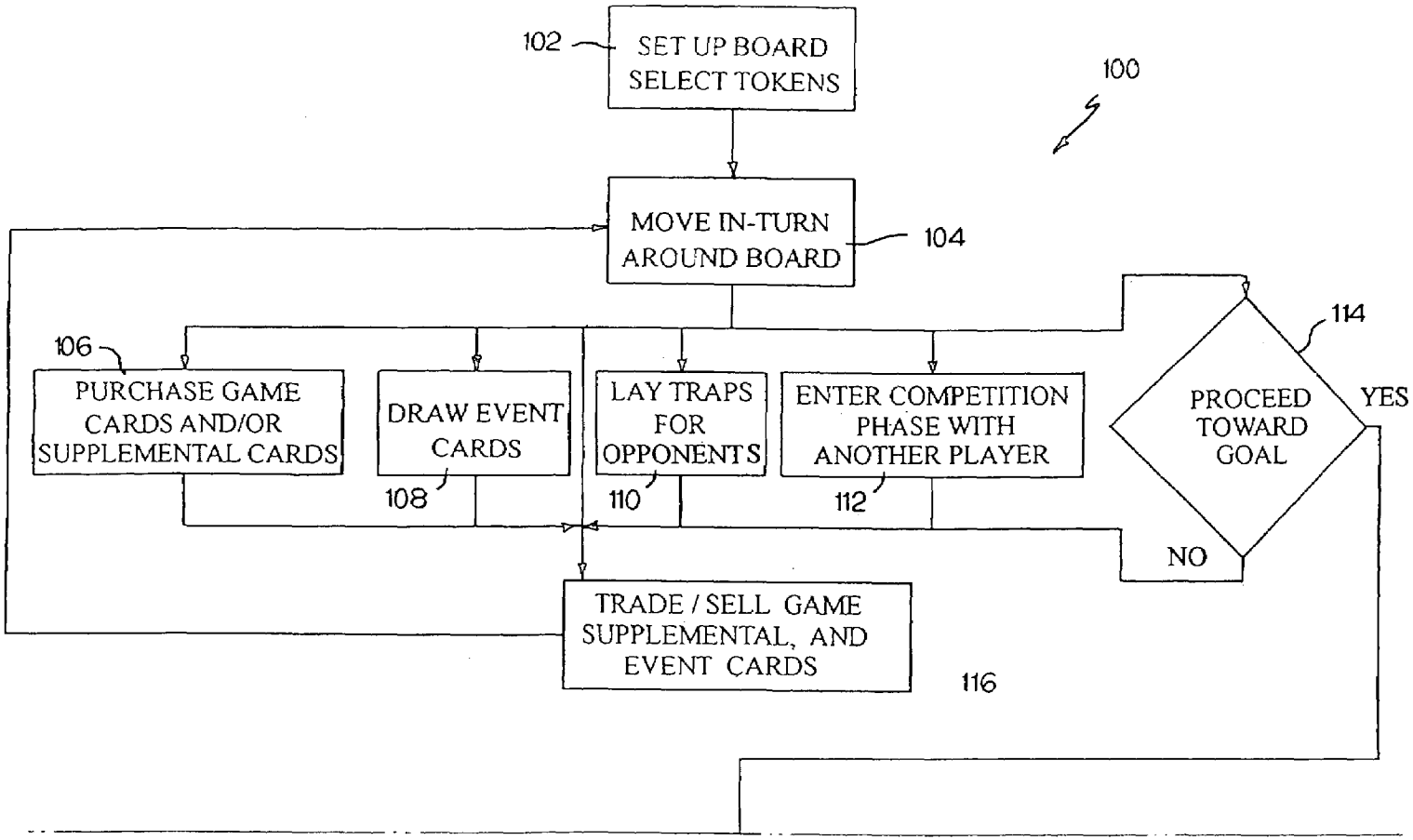
FIGS. 6A and 6B collectively provide a schematic diagram of a methodology of playing the game illustrated in FIGS. 1-5.
Figure 6B:
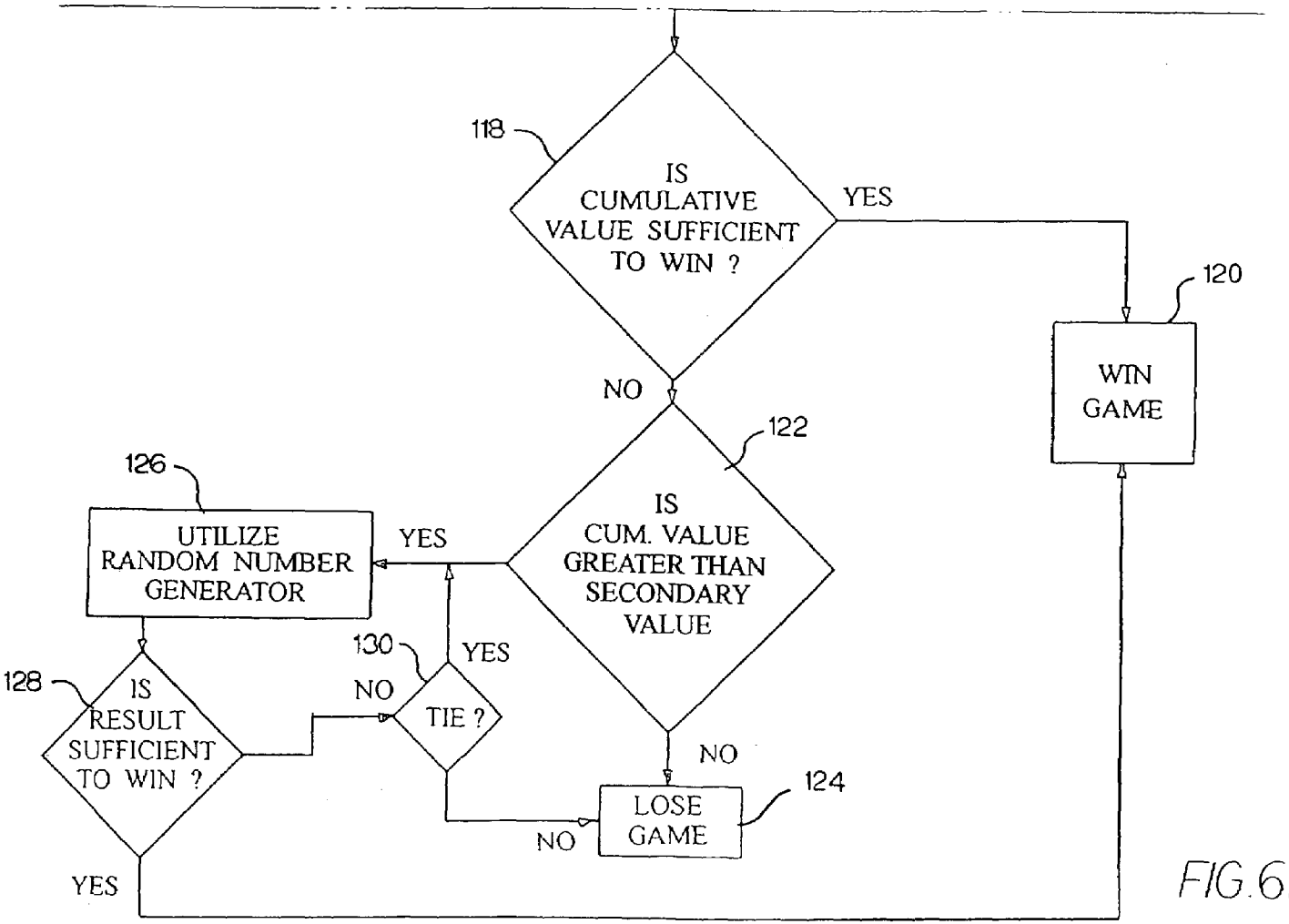

With reference now to FIG. 6, a method of playing a board game 10 in accordance with the present invention will now be described. The method of playing is schematically illustrated in flow chart 100. As represented in block 102, the game begins by placing the game board 12 in a central location relative to the players so each player can readily see the entire board 12. In this step, players select a token 16 which will represent the player on the board 12 during the game. The board 12 is prepared by randomizing the event cards 20 and placing them front face 31 down on area 64. Each player is also given a predetermined starting amount of game scrip 22. One player is appointed to assist in the play of the game 10 by acting as a game Facilitator or Treasury and controls the extra game scrip 22 and the uncollected or non-purchased game cards 14 and supplemental cards 21 for the benefit of all the players.

Next, as represented in block 104, players take turns moving around the game board 12 along path 50 by using the random number generator 18 and moving the token 16 a number of spaces 51 equal to the number provided by the generator 18. In the preferred embodiment, the player rolls two six-sided dice. If the roll results in both of the dice showing the same number (i.e., if the player rolls "doubles"), then that player is allowed to re-roll and move again after his turn is over.

After a player has moved, he will have stopped on one of the various spaces along the path 50.

If the player stops on an ordinary game space 51, then that player's movement turn is over. If the player stops on a space enclosed within a store 52, the player may follow the step shown in block 106. If the player stops on a space designated as an event card space 59, the player follows the step shown in block 108. If the player stops on a space designated as a trap space 58, the player may follow the step shown in block 110. If the player stops on a space occupied by another player, then step 104 is followed by the step shown in block 112. Lastly, if the player stops on a space designated as a portal space 61, the player may follow the step shown in block 114.

In the preferred embodiment, the starting point 54 and the store spaces 52 are treated as ordinary game spaces 51 with the following exception, when any player stops on the starting point 54 or store space 51 and it is already occupied by another player, the game does not enter the competition phase 112. Instead, these spaces 51, 54 are deemed "neutral ground" in the game 10 and the two (or more) players merely occupy the same space.

The penalty region 55 is not a space that players normally traverse while following the path 50. Instead, penalty region 55 is set-off from the path 50. In the preferred embodiment, the penalty region 55 is adjacent to the starting space 54, but it may be located along other portions of the game board 12. During play, the penalty region 55 operates to provide a location to temporarily detain a player for a certain number of rounds or turns as a penalty for certain game infractions. All players that are sent to the penalty region 55, go to the same location and then restart the game (after serving their time penalty) at the same spot along the path 50. In one embodiment, the starting space 54 operates as this re-entry space.

In one non-limiting embodiment, the players receive an amount of game scrip 22 each time they traverse the starting space 54.

After the player that lands on the above spaces 51, 52, 54, 58, 59 and has followed the applicable steps for that space (described below) and the game has not ended, the players then enter the step shown in block 116. After step 116 has ended, the next player's turn begins at step 104. This pattern continues until one player wins the game 10.

In the step represented in block 106 the player has the option to use game scrip 22 to purchase various game cards 14 and one of the types of supplemental cards 21. If a player elects to purchase from the store 52, the player pays a predetermined amount for the card(s) 14, 21 to the Facilitator. This amount is placed with the rest of the currently unused game scrip 22. Each game card 14 is categorized into one of a plurality of different classes.

In the preferred embodiment, each store 52 only sells one of the different classes of game cards 14 and one type of supplemental card 21. Additionally, a player may only purchase a game card having a level higher than level one if that player is in possession of a game card in the same class that is exactly one level below the game card being purchased. For example, in order to purchase a level 3 Weapon class game card, then the player must be in possession of a level 2 Weapon class game card at the time of purchase. A player purchasing a higher level game card need only possess the game card having the next lowest level and does not need to be in possession of other lower level rated game cards (e.g., to purchase a level 4 card, a player only needs to possess the applicable level 3 card, not the applicable level 1 or level 2 card).

Further, each player may only be in possession of a certain number of any particular game card 14 or supplemental card 21. That is, a player may only possess two identical cards of any type. If a player obtains a game card 14 or a supplemental card 21 that he already has two of, then that player must sell or trade the extra card during step 116.

Lastly, at most only one level of game card 14 and two supplemental cards 21 may be purchased during any single turn by a player (and only if the player lands within a store space 51). Players may, if they have sufficient game scrip 22, purchase up to two game cards 14 that are the same level. That is, if a player stops in a store 52, he may purchase up to two identical game cards 14 and up to two supplemental card 21 even if he has enough game scrip 22 to purchase more.

As represented in block 108, if a player stops on an event card space 59, the player draws a event card 20 from the stack of face down cards 20 located in area 64 on the board 12. The event card 20 provides instructions to the player to perform a certain game related activity. The player must comply with the directions provided on the event card 20. While most event cards 20 will immediately affect the player landing on the space 59, some of the drawn event cards 20 may be retained by the player to be used/sold/traded at his discretion during the course of the game. Once an event card 20 has been played (i.e., the applicable player(s) have followed the directions of the card), the card 20 is returned to the bottom of the stack of cards located on area 64. The stack of event cards may include multiple copies of a particular card 20.

In one non-limiting embodiment, one of these retainable event cards 20 permits the bearer to avoid the effects of trap spaces 58 or a competition phase initiated during the game involving that player.

As represented at block 110, if a player stops on a trap space 58, one of three different possibilities may occur. The first two are available if another player has not previously set a trap in that particular space. If this is the case, then the player may elect to do nothing and the space 58 is treated as an ordinary space 51. Alternatively, the player may elect to pay a predefined amount of game scrip 22 to set a trap for opposing players who later stop at that space 58. If the player elects to set the trap, he pays the amount of scrip 22 to the game Facilitator and the trap is thereby set for the next player to stop at that space later in the game.

The trap spaces 58 enable a player to automatically take a particular game card 14, supplemental card 21, or game scrip 22 from any opposing player that stops on the trap.

In the preferred embodiment, each trap space 58 along the path 50 is designated with what particular card 14, 21 the purchasing player will receive from an opponent if that opponent is in possession of that particular card and he lands on the trap space 58. That is, each particular trap space 58 will only retrieve a particular type of card 14, 21 from a later arriving opponent and only if that opponent is in possession of that particular card. Alternatively, the trapping player may elect to take a predetermined amount of game scrip 22 from the trapped player. Once a trap has been "sprung" and the trapping player has received his card or scrip, the trap space 58 he purchased will again become available to any subsequent players that stop on the trap space 58, including the player who previously set the trap.

In other embodiments of the game 10, a player setting a trap may select which type of card 14, 21 or amount of scrip 22 that he desires from the trapped player. In this embodiment, the more valuable or powerful the item taken from the trapped player, the higher the cost to set the trap.

Further, in one embodiment of the game 10, a marker or token (not shown) representing each trap space 58 on the board 12 is provided. This marker is given to the player setting the trap to aid the players in determining whether a particular trap space 58 has been set by any game players.

As represented at block 112, if a player stops on a space occupied by another player, the game enters a competition or battle phase in which the moving or "attacking" player competes against the player already occupying the space. If more than one player occupies the space, the moving player may select which of the occupying players he will compete against.

Figure 7:
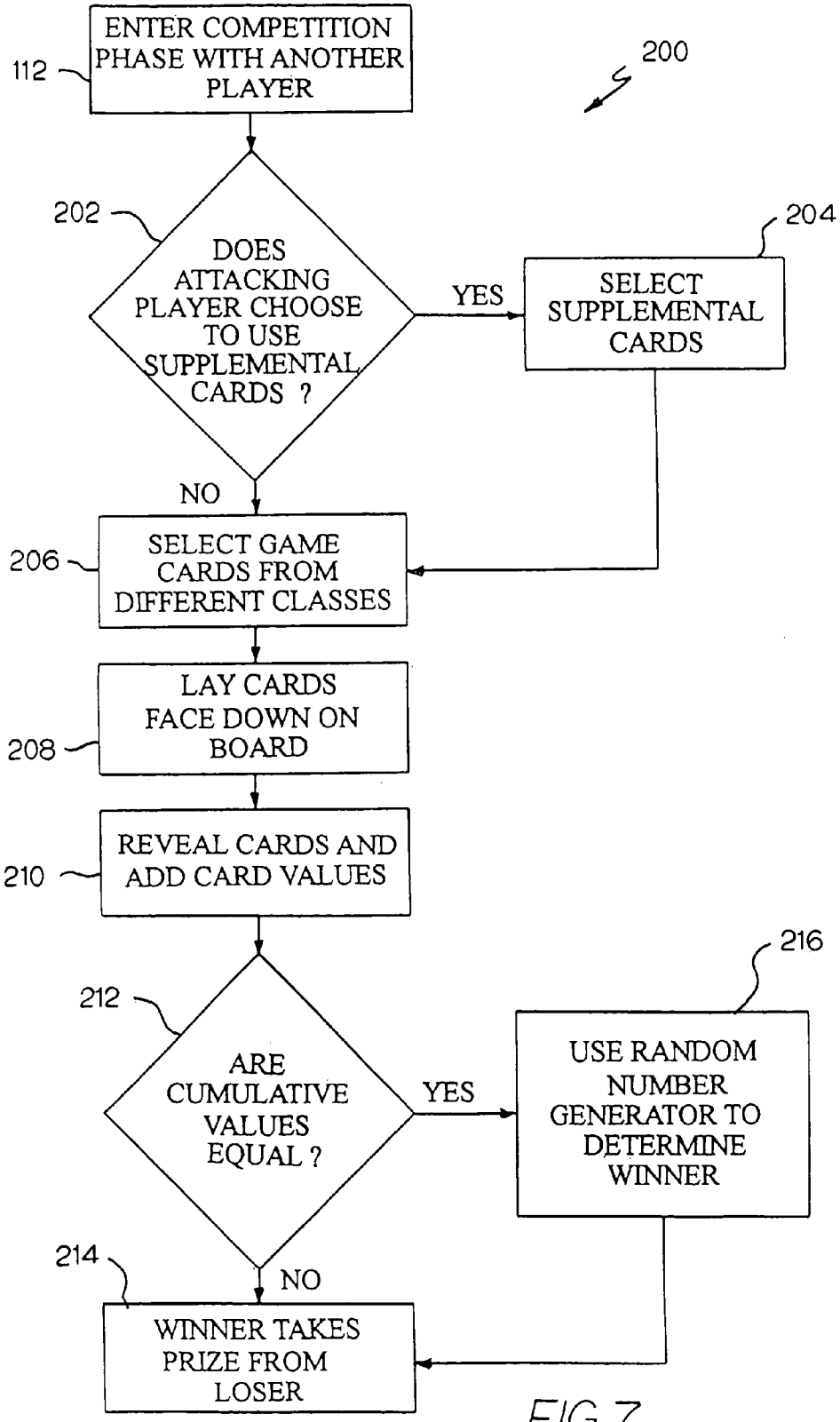
FIG. 7 is a schematic diagram of the competition phase of the methodology illustrated in FIG. 6.

As shown best in FIG. 7, the competition phase step 112 of game 10 is schematically illustrated in flow chart 200. The competition phase starts at step 112, where the moving or attacking player selects which opponent he will compete against if more than one player occupies the same space. Additionally, if any player has an event card 20 which may affect or negate the competition phase, the player must declare at this point whether the card 20 will be played.

Step 202 follows step 112 and in this step 202, the attacking player has the option to decide whether supplemental cards 21 can be utilized during this competition phase. If the attacking player chooses to compete without supplemental cards, then neither player may use supplemental cards and step 206 follows step 202.

If the attacking player elects to use supplemental cards 21, step 204 follows step 202 and in this step 204, the attacking player may select from his collection of supplemental cards 21 and the player being attacked or defending player is also permitted to select from his own collection of supplemental cards 21. These selected supplemental cards 21 are then used to bolter the player's total during the resolution of the competition phase. In the preferred embodiment, only one supplemental card 21 associated with each class of game card 14 may be used in determining a cumulative game value. That does not mean, however, that a player can only select one of a certain type of supplemental card 21 to proffer for the pending reveal. In this manner, a player may choose two identical supplemental cards for a competition phase. In this manner, the player only receives the benefit of the game value of one of the cards (the other is ignored for cumulative value determination), but the player may convince his opponent that he may need to use more powerful (in game value) game cards 14 during the competition phase in order to win and thus may get a favorable game card "match-up" where his selected game cards 14 negate one or more of his opponents cards.

The next step in the competition phase of the game 10 is step 206 and in this step 206, each competitor selects which game cards 14 he will utilize during this competition phase. In the preferred embodiment, the players may select any of the game cards 14 in their possession at the start of the competition phase, but can only select one game card 14 of each class. The player must play each of the different classes of game cards 14 if he is in possession of at least one of that class. Additionally, the selection of cards during the competition phase is done in secrecy as neither player should see which cards his competitor has elected to play.

In the preferred embodiment, the selection of which game cards 14 to use is based on many factors, including the above-mentioned number of supplemental cards 21 selected by the opponent.

One other factor in selecting the game cards 14 is what zone 56 the competition originated in (i.e., the zone 56 where the two competitors occupy the same space on the path 50). This is because certain game cards 14 have different game values in certain zones 56. This variation in game value will be shown, if at all, on some cards in information box 30.

Another factor in selecting the game cards 14 is what game cards 14 the player's competitor is likely to play during that competition phase. In this determination, the player must first try to remember which game cards 14 his opponent currently has in his possession. Secondly, the player must weigh the pros and cons of selecting the various levels and classes of game cards. This is because certain game cards may have their game values increased or decreased depending on the game cards 14 the opposing player elects to put into play. For example and without limitation, in the above described medieval/fantasy embodiment, the Stone Shield has a greater game value than the Steel Shield, but if the player's opponent elects to use his Hammer, the game value of the Stone Shield is negated (i.e., brought down to zero in game value).

Another factor in selecting which game cards 14 to play is: which cards 14 are the player willing to part with should he lose the competition phase. This is because the player having the highest cumulative game value is declared the winner of the competition phase and is awarded the option of taking from the losing player any of the game cards 14, supplemental cards 21 (if played) that the losing player used in the competition phase, or a predetermined amount of game scrip 22 from the losing player.

In other embodiments, certain event cards 20 may affect the cumulative total of the competitors according to the directions which may be in information box 36.

Once the players have selected their game cards 14 in step 206, the competition phase proceeds with step 208. In step 208, the players place their selected cards 14, 21 (if applicable) front sides down onto the competition phase region 65 on the game board 12.

Step 210 follows step 208 and in this step 210, the players reveal to all the players which cards 14, 21 have been selected for the competition phase. The players add the total numerical game values of each of the cards, taking into account any of the positive and negative effects the particular cards 14 may have on each other and which zone 56 the competition is originated in.

Next, in step 212, the players determine whether the cumulative game values of the cards played are equal. If they are not equal, then step 214 follows step 212 and the player having the higher cumulative total is declared the competition phase winner and is awarded the opportunity to select a prize from the losing player as described above.

If the cumulative game values in step 212 are equal, then step 216 follows step 212 and the players each utilize the random number generator 18 as a secondary means for determining which player wins the competition phase. The player having the highest result from the random number generator 18 is declared the winner and step 214 follows step 216.

In another embodiment, if a tie in cumulative game values is first reached in step 210, the players restart the competition phase at step 206 to see if either player elects to vary his strategy. If a second tie results, then the random number generator 18 is used to determine a winner.

Referring back to FIG. 6, another possible step 114 following step 104 may result if the player stops at a portal space 61. In step 114, the player is given an option whether to proceed toward the goal 60 or to continue moving around the path 50. If the player elects to continue around the path 50, then the portal space 61 is treated as an ordinary space 51 and step 116 follows step 114.

In step 116, which follows the conclusion of steps 106, 108, 110, 112 and step 114 as described above, the players may freely trade or sell any of their game cards 14, event cards 20, and/or supplemental cards 21 in their possession to any of the other players. In one embodiment, the players may collectively review a trade or sale of cards and vote to determine whether a particular transaction is fair. If deemed unfair, the transaction is voided and the reviewing players may assess a penalty on the "cheating" players.

In the preferred embodiment, if a player is forced to sell a card 14, 21 due to his current possession of more than two of a particular card, then the player may elect to either return the card to the Facilitator for a predetermined amount (e.g., for half of the purchase price of the card), paid out from the unused game scrip 22. The card would then be returned to the uncollected pile controlled by the Facilitator. Alternatively, the forced player can elect to auction the extra card to the highest bidder. Once all transactions have been completed, step 116 is followed by step 104 for the next player.

If the player elects in step 114 to proceed toward the goal 60, then step 118 follows step 114. In step 118, the player determines the maximum cumulative value he can bring to bear in a competition phase, ignoring any bonuses due to zone 56 or potential card match-ups. If this cumulative amount is greater than a certain predetermined value, then step 120 follows step 118 and the player wins and the game 10 is over.

If, however, the player's maximum cumulative game value is not sufficient to win the game outright, step 122 follows step 118 and the maximum cumulative game value is compared to a second predetermined value. If the number is less than this second value, then step 124 follows step 122 and the players loses and is out of the remainder of the game.

If the player does have a maximum cumulative game value greater than or equal to the second predetermined value, then step 126 follows step 122 and the player used the random number generator 18. Next in step 128, the number generated is compared to a predetermined alternative winning number, if the generated number is greater than the number, step 124 follows and the player is declared the winner.

If the number generated is not sufficient to win the game, then step 130 follows step 128, if the number was less than the predetermined alternative winning number, then step 124 follows step 130 and the player loses and is out of the remainder of the game. If the number generated is equal to the predetermined alternative winning number, then step 130 is followed by step 126 and the process is repeated to determine whether the player wins or loses the game.

As noted above, the preferred embodiment of the present invention is illustrated to include a board game 10 in which cards 14, 20, 21 are collected and utilized to compete against other game players in head-to-head competitions or battles. One skilled in the art will readily recognize that the present invention may be readily adapted to provide additional possible variations in the number and kind of game cards 14, event cards, and supplemental cards 21 as dictated by the specific application. Generally, the more classes of game cards 14 in a given game 10, the more complicated the resultant game 10. Likewise, a particular design and shape of the game board 12 and path 50 may be modified as dictated by the specific theme and application. For example, as the embodiment illustrated in the drawings presently contemplates a board 12 having a path 50 which generally follows the periphery of the board; however, the path 50 may be reconfigured to provide a generally serpentine-shaped path which bends and curves to provide a path 50 where optional shortcuts may be taken by the players during the game. In various embodiments, these shortcuts may require a fee.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A method of playing a board game comprising the steps of:

providing a plurality of cards that are classified in at least three classes, each of said cards having a numeric value and a numbered level;

moving a game piece around a path formed from a plurality of spaces based upon an outcome of a random number generator, wherein said path includes at least one store space;

collecting said cards as each game piece traverses said path and selectively purchasing one of said cards when said game piece lands on a store space;

allowing a player to purchase a card in a certain class having a higher level only if that player is in possession of a card in the same class having a level that is immediately below the card being purchased; and entering a competition phase between two game players when both players occupy the same space, said competition phase comprising:

selecting one card available from each one of said classes; and comparing a cumulative value of said selected cards, wherein the player with a higher cumulative value is declared the competition phase's winner.

2. The method of claim 1 wherein said competition phase further comprises the step of:

taking from the losing player, either one of the cards selected for said competition phase or an amount of game scrip and giving it to the winning player.

3. The method of claim 1 further comprising the steps of:

collecting cards having a cumulative value greater than a winning value; and moving said game piece to a final location on said path.

4. The method of claim 1 wherein at least one of said spaces are trap spaces, said method further comprising the steps of:

wherein a player who first lands on each trap space may elect to lay a trap on a subsequent player;

causing a second player who lands on the same trap space to give either a predetermined card or a predetermined amount of game scrip to the first player, after which, said trap space becomes available for purchase again.

5. The method of claim 1 wherein said at least three classes of cards comprise primary cards, secondary cards, and tertiary cards.

6. The method of claim 5 wherein certain primary and secondary cards correspond to certain tertiary cards, said method further comprising the step of:

decreasing said numeric value of a tertiary card used during a competition phase if the opposing player selected a primary card or a secondary card corresponding to said tertiary card.

7. The method of claim 1 wherein said path is divided into different color-coded areas and wherein certain cards are also color-coded to correspond to said areas, said method further comprising the step of:

increasing said numeric value of said color-coded card if it is used during a competition phase initiated in a corresponding color-coded area.

8. The method of claim 1 wherein said path includes at least one random event space, said method further comprising the steps of:

providing a plurality of random event cards, each of said cards includes a set of instructions which a player must follow; and collecting a random event card each time a random event space is landed on by a game piece.

9. The method of claim 1 wherein said step of selecting one card from at least one of said classes further comprises the steps of:

hiding said selected cards from the other game players; and revealing said hidden selected cards to said other game players.

10. A method of playing a board game comprising the steps of:

providing a plurality of cards that are classified in at least three classes, each of said cards having a numeric value;

moving a game piece around a path formed from a plurality of spaces, wherein said path is divided into different color-coded areas and wherein certain cards are also color-coded to correspond to said areas;

collecting said cards as each game piece traverses said path; and entering a competition phase between two game players when both players occupy the same space, said competition phase comprising:

selecting one card available from each one of said classes;

increasing said numeric value of said color-coded card by a designated value if it is used during a competition phase initiated in a corresponding color-coded area;

comparing a cumulative value of said selected cards, wherein the player with a higher cumulative value is declared the competition phase's winner.

11. The method of claim 10 wherein said path includes at least one store space, said method further comprising the step of:

selectively purchasing one of said cards when said game piece lands on a store space.

12. The method of claim 10, said method further comprising the step of awarding the player having a higher cumulative value a prize from the player having a lower cumulative value.

13. The method of claim 12 wherein said prize includes one of said losing player's selected game cards or an amount of game scrip.

14. The method of claim 10 wherein at least one of said spaces are trap spaces, said method further comprising the steps of:

wherein a player who first lands on each trap space may elect to lay a trap on a subsequent player;

causing a second player who lands on the same trap space to give either a predetermined card or a predetermined amount of game scrip to the first player, after which, said trap space becomes available for purchase again.

15. A method of playing a board game comprising the steps of:

providing a plurality of cards that are classified in at least three classes including primary cards, secondary cards, and tertiary cards, wherein certain primary and secondary cards correspond to certain tertiary cards, and wherein each of said cards has a numeric value;

moving a game piece around a path formed from a plurality of spaces;

collecting said cards as each game piece traverses said path; and entering a competition phase between two game players when both players occupy the same space, said competition phase comprising:

selecting one card available from each one of said classes;

decreasing said numeric value of a tertiary card by a designated value used during a competition phase if the opposing player selected a primary card or a secondary card corresponding to said tertiary card; and comparing a cumulative value of said selected cards, wherein the player with a higher cumulative value is declared the competition phase's winner.

16. The method of claim 15 wherein said path includes at least one store space, said method further comprising the step of:

selectively purchasing one of said cards when said game piece lands on a store space.

17. The method of claim 15 wherein at least one of said spaces are trap spaces, said method further comprising the steps of:

wherein a player who first lands on each trap space may elect to lay a trap on a subsequent player;

causing a second player who lands on the same trap space to give either a predetermined card or a predetermined amount of game scrip to the first player, after which, said trap space becomes available for purchase again.

18. The method of claim 15 wherein said path is divided into different color-coded areas and wherein certain cards are also color-coded to correspond to said areas, said method further comprising the step of:

increasing said numeric value of said color-coded card if it is used during a competition phase initiated in a corresponding color-coded area.

* * * * *

UNITED STATES PATENT AND TRADEMARK OFFICE

CERTIFICATE OF CORRECTION

PATENT NO. : 7,374,171 B1
APPLICATION NO. : 11/353664
DATED : May 20, 2008
INVENTOR(S) : Dean A. Mencarelli It is certified that error appears in the above-identified patent and that said Letters Patent is hereby corrected as shown below:

Title page.
Item [76], Inventor, replace "Dea A. Mencarelli, 5700 Mencarelli Dr., La Salle, ON (CA) N9H 2M6" with --Dean A. Mencarelli, 5700 Mencarelli Dr., La Salle, ON (CA) N9H 2M6--.

Signed and Sealed this

Fifth Day of August, 2008

JON W. DUDAS
*Director of the United States Patent and Trademark Office*